US006818071B2

(12) United States Patent
King

(10) Patent No.: US 6,818,071 B2
(45) Date of Patent: Nov. 16, 2004

(54) METHOD AND APPARATUS FOR CLEANING A ROLLER COVER

(76) Inventor: Ronnald B. King, 3405 S. Manito Blvd., Spokane, WA (US) 99203

( * ) Notice: Subject to any disclaimer, the term of this patent is extended or adjusted under 35 U.S.C. 154(b) by 0 days.

(21) Appl. No.: 10/199,686

(22) Filed: Jul. 18, 2002

(65) Prior Publication Data

US 2003/0010365 A1 Jan. 16, 2003

Related U.S. Application Data

(63) Continuation of application No. 09/661,333, filed on Sep. 13, 2000, now Pat. No. 6,446,648, which is a continuation-in-part of application No. 09/502,870, filed on Feb. 11, 2000, now abandoned.

(51) Int. Cl.[7] ..... B08B 3/04

(52) U.S. Cl. ..... 134/33; 134/149; 134/157; 134/900; 68/213

(58) Field of Search ..... 134/146, 137, 134/149, 900, 140, 147, 157, 152, 32, 33; 68/213

(56) References Cited

U.S. PATENT DOCUMENTS

| | | | | |
|---|---|---|---|---|
| 2,542,491 | A | * | 2/1951 | Engel |
| 2,912,769 | A | | 11/1959 | Kruger |
| 3,436,264 | A | * | 4/1969 | Allen |
| 3,733,645 | A | * | 5/1973 | Seiler |
| 3,873,364 | A | * | 3/1975 | Smith ..... 134/138 |
| 4,263,055 | A | * | 4/1981 | Permar |
| 4,311,158 | A | * | 1/1982 | Harvey |
| 4,332,067 | A | * | 6/1982 | Pearce |
| 4,545,395 | A | * | 10/1985 | Kolb |
| 5,185,938 | A | * | 2/1993 | Hutt |
| 5,539,948 | A | * | 7/1996 | McCauley et al. |
| 5,588,221 | A | | 12/1996 | Hoeltke et al. |
| 5,873,176 | A | | 2/1999 | Richards |
| 5,938,534 | A | | 8/1999 | Kurian et al. |
| 6,012,473 | A | * | 1/2000 | Koyama |
| 6,038,787 | A | * | 3/2000 | Dean et al. |
| 6,073,362 | A | * | 6/2000 | Dean et al. |
| 6,088,933 | A | | 7/2000 | Mallalieu |
| 6,115,935 | A | | 9/2000 | Collins et al. |
| 6,520,672 | B1 | * | 2/2003 | Whitney |

FOREIGN PATENT DOCUMENTS

| | | |
|---|---|---|
| FR | 2689788 | * 10/1993 |
| FR | 2707852 | * 1/1995 |
| GB | 2219732 | * 12/1989 |
| GB | 2245481 | * 1/1992 |
| GB | 2350551 | * 12/2000 |

* cited by examiner

*Primary Examiner*—Frankie L. Stinson
(74) *Attorney, Agent, or Firm*—Weide & Miller, Ltd.

(57) ABSTRACT

An apparatus and method for cleaning a roller cover of the type used to apply a coating material is disclosed. In one embodiment the apparatus includes a body, at least one roller cover engaging element for positioning at least partially within the interior area of a roller cover and engaging the roller cover, and a drive adaptor associated with the body for effectuating rotation of the roller cover engaging element, and thus a roller cover connected thereto, with a drive. In one embodiment, the drive adaptor comprises a shaft connected to the body of the apparatus and extending therefrom, the shaft adapted to be rotated by a drive. A method of cleaning a roller cover comprises inserting at least a portion of a body of a roller cover cleaning apparatus into a generally hollow interior section of a roller cover, engaging the roller cover with the body such that rotation of the body effectuates rotation of the roller cover; placing the roller cover into a cleaning solution, and rotating the roller cover with the roller cover cleaning apparatus in the cleaning solution. One or more methods of the invention include the step of drying a cleaned roller cover by rotating it in air.

16 Claims, 6 Drawing Sheets

METHOD AND APPARATUS FOR CLEANING A ROLLER COVER

RELATED APPLICATIONS

This application is a Continuation of U.S. application Ser. No. 09/661,333, filed Sep. 13, 2000, now U.S. Pat. No. 6,446,648 which is a Continuation-in-Part application of U.S. application Ser. No. 09/502,870 filed Feb. 11, 2000, now abandoned.

FIELD OF THE INVENTION

The present invention relates to a method and apparatus for cleaning a roller cover of the type used to apply paint or other coatings to surfaces.

BACKGROUND OF THE INVENTION

Devices known as "rollers" are commonly used to apply liquid and semi-liquid coatings to surfaces. Such devices normally comprise a roller cover which is placed on a roller cover mount. The roller mount generally includes a handle having an elongate rod extending therefrom. A user grips the handle. In use, the roller cover is mounted on one or more support elements rotatably positioned on the rod. The mounting of the roller cover on the support element(s) permits the roller cover to rotate freely about an axis extending through the roller cover parallel to the rod.

There are a variety of types of roller covers. Generally, the roller covers are cylindrical in shape, having a hollow supporting member for accepting the support element(s) of the roller handle. The supporting member may comprise a cardboard or plastic tube or similar member. A material which has the ability to retain or absorb an amount of coating material is located on the exterior of the supporting member. This material may comprise foam, fiber material or the like.

In use, a coating material is applied to the roller cover, some of the coating material being retained in the fibrous exterior of the roller cover. The user presses the roller cover against the surface to which the coating is to be applied. The user pushes the roller cover with the handle, causing the roller cover to roll over the surface. As the roller cover rotates, coating material trapped in the roller cover is applied to the surface.

The roller cover may be used to apply a wide variety of coatings. The roller cover is commonly used to apply paint. Other materials, however, such as varnish, sealants and the like may be applied with such covers.

Roller covers vary in price and quality. In many instances, however, a particular roller cover is sufficiently durable that it may be used on more than one occasion. In order to re-use a roller cover, the roller cover must be thoroughly cleaned after its first use. Otherwise, the coating material will generally cure in the fiber material, hardening it and preventing the roller cover from retaining coating material in subsequent uses. In addition, even a few hardened fibers will generally leave an impression in recently applied coating material as applied to a given surface.

Roller covers are commonly cleaned by spraying a cleaning material onto the roller cover and working the cover (such as by kneading or stroking the cover with one's hands) to lift away the coating material trapped in the fiber. For example, if the coating material applied was latex paint, then the cleaning material may comprise water. A user may place the roller cover in the sink and spray water onto the cover and work it in an attempt to wash away the embedded paint.

The process of cleaning the roller cover is generally not particularly effective. For example, when a roller cover is sprayed with water, the water usually does not penetrate the fiber material sufficiently to lift away the paint. A user may use his or her hands to compress and release the fiber material to flush the water and paint material from the fiber. If the cover is not thoroughly cleaned, then the embedded coating material will harden and ruin the cover.

In some instances the cover is ruined trying to clean it because of the difficulty in cleaning the cover. For example, when the roller cover has a cardboard, phenolic or other supporting tube, during a prolonged cleaning period in which a user attempts to flush all the coating material from the cover, the tube may be destroyed. The tube may warp, peel, degrade or otherwise lose strength or integrity, preventing re-use of the roller cover.

Because of the time and effort, many users simply throw away each roller cover after a single use. This is very wasteful and costly to the user.

The current method of cleaning a roller cover is also very messy, requiring a user to grasp and work the cover while rinsing it. The cleaning method requires access to running water, such as at a sink or hose, and usually a basin or other location for containing and/or draining the contaminated water. During the working and spraying of the cover, splashing of the water and coating material from the cover may affect the user. To dry the cover, the user may squeeze water and material from the cover and/or store the cover in a location where the material which drains therefrom is contained and does not ruin any surrounding items.

Several attempts have been made at developing a better method of cleaning a roller cover. These attempts are little better than the method of hand cleaning, both in terms of their effectiveness and ease of use.

One attempt involves use of a donut-shaped device having a central opening. Multiple spray ports are positioned in the device facing the central opening. A water inlet is provided to the device, such as for connection of a hose. In use, water flows through the inlet into the device and then out through the spray ports. A user passes a roller cover back and forth through the central opening, permitting the water being sprayed into the central opening to contact the roller cover. Unfortunately, this device is not much more effective in cleaning a roller cover than just spraying the roller cover with water from a hose or faucet. In addition, the method is messy, as the user must still grasp the roller cover during cleaning. Water from the small jets also tends to spray and splash everywhere, getting the user and surrounding area wet and dirty.

Another attempt involves use of a device which includes a hollow cylinder. A roller cover is placed inside the device. A lid is then placed over a top end of the cylinder and a water source is connected. Water flows through the device and onto the roller cover. The water and debris then flows from the device out an open second end. This device has an advantage over the previous device in that the cleansing water is somewhat contained during cleaning, and the user need not grasp the cover during cleaning. On the other hand, the method is still not very effective in cleaning the roller cover. One problem is that water may not be directed at one or more areas of the roller cover in sufficient quantity or with sufficient force to clean it.

Both of these devices also do not solve the problem that the cover remains wet once cleaned, and can not be immediately re-used, and if stored may rot. Both devices also require a water hook up, such as a hose or faucet.

A method for cleaning roller covers which overcomes the above-stated problems and permits convenient re-use of roller covers is desired.

SUMMARY OF THE INVENTION

The present invention comprises a method and apparatus for use in cleaning a roller cover of the type which is used to "roll-apply" a coating material.

In one or more embodiments, the invention comprises an apparatus having a body with at least one cover engaging element for positioning at least partially within the interior area of a roller cover, and a drive adaptor associated with the body by which the roller cover engaging element may be rotated, thus causing rotation of the roller cover connected thereto.

In one or more embodiments, the body of the apparatus includes a plurality of radially extending fins for engaging the roller cover. In one embodiment, the fins are tapered so as to have a small dimension at a first end which is inserted into a roller cover, and an increased dimension between the first and an opposing second end for engagement with the roller cover. In one or more embodiments, one or more of the fins may be flexible.

In one or more embodiments, the body of the apparatus includes at least one disc element having a circumference for engaging a roller cover. In one or more other embodiments, the body comprises at least one rod which is compressed when inserted into a roller cover, generating a biasing force and engaging the cover. In one or more other embodiments, the body is barrel-shaped.

In one or more embodiments, the body of the apparatus 20 has a support element having at least a first and a second outer strut extending from the support element, the first and second outer struts positioned to transmit generally opposing radially directed roller cover engaging forces. The body includes an inner strut associated with at least one of the first and second outer struts, the inner strut connected to the outer strut but spaced therefrom and arranged to generate a radially directed force to the outer strut. In one or more embodiments, a support is positioned between the outer struts and one or more stabilizers extend outwardly generally perpendicular to a plane in which the struts lie.

In one or more embodiments, the drive adaptor comprises a shaft or other member connected to the body of the apparatus and extending therefrom, with the shaft adapted to be rotated by a drive. The drive preferably comprises a means for rotating the shaft at high speed. In one embodiment, the drive comprises an electric drill.

One or more embodiments of the invention comprise a method of cleaning a roller cover. In accordance with one or more embodiments the method comprises inserting at least a portion of a body of a roller cover cleaning apparatus into an interior section of a roller cover, engaging the roller cover with the body such that rotation of the body effectuates rotation of the roller cover, placing the roller cover into a cleaning solution, and rotating the roller cover with the roller cover cleaning apparatus in the cleaning solution.

In accordance with one or more embodiments of the invention, the roller cover cleaning apparatus includes a shaft extending from the body and the method includes the step of connecting the shaft to a rotary drive apparatus and rotating the roller cover with the rotary drive apparatus.

Further objects, features, and advantages of the present invention over the prior art will become apparent from the detailed description of the drawings which follows, when considered with the attached figures.

DETAILED DESCRIPTION OF THE INVENTION

The invention is a method and apparatus for cleaning a roller cover. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Figure 3:
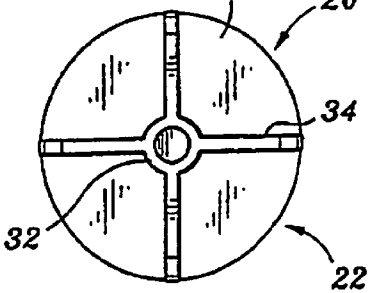
FIG. 3 is an end view of the roller cover cleaning apparatus illustrated in FIG. 1.

An embodiment of the invention will be described first with reference to FIGS. 1–3. As illustrated therein, there is provided a roller cover cleaning apparatus 20. The roller cover cleaning apparatus 20 has a body 22 for mating with at least a portion of a roller cover, and a drive adaptor 24 for use in driving the body 22.

Figure 1:
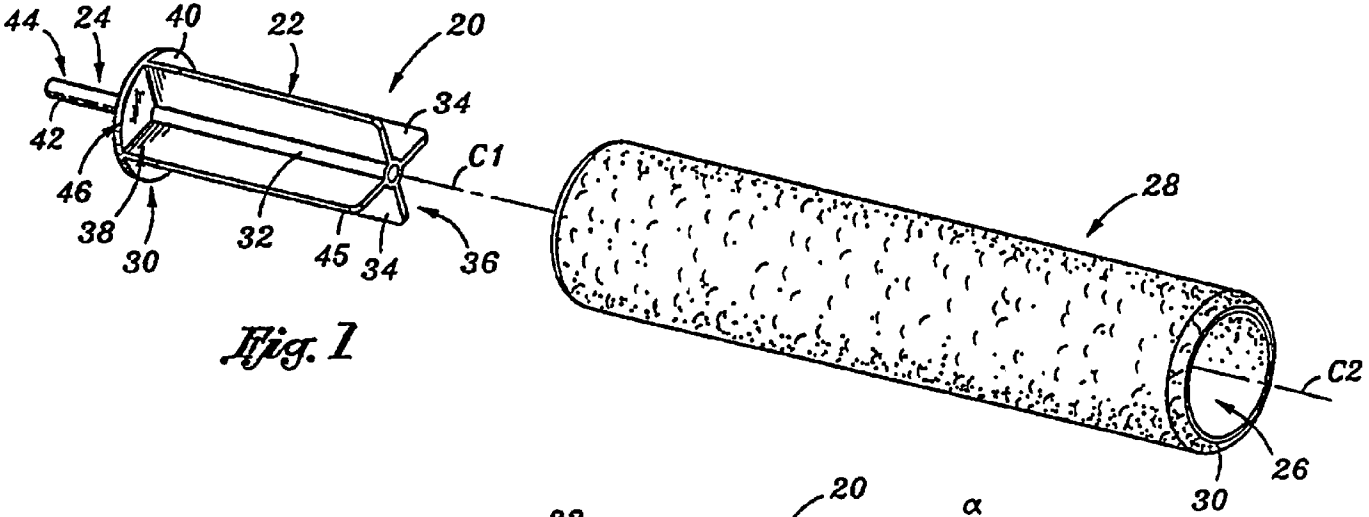
FIG. 1 is a perspective view of a roller cover cleaning apparatus in accordance with one embodiment of the invention for use in a method of cleaning a roller cover.

Referring to FIG. 1, at least a portion of the body 22 of the apparatus 20 is adapted to fit within the hollow interior 26 of a roller cover 28. The roller cover 28 illustrated in FIG. 1 is for illustration purposes only, it being understood that the apparatus 20 of the invention may be used with roller covers having a wide variety of shapes, sizes, constructions and the like. In the arrangement illustrated, the roller cover 28 generally comprises a cylinder having a passage extending therethrough from end to end, this passage comprising the hollow interior of the roller cover 28. More specifically, in the example illustrated, the roller cover 28 has an elongate supporting tube 30 which defines the hollow interior 26. An axis C2 passes through the tube 30. Fibrous or similar absorbing material is positioned on the outside of the tube 30 for use in retaining a coating material for application.

The body 22 has a central support 32. The central support 32 may have a variety of configurations and constructions, and may be a solid rod, generally hollow tube or other element. The body 22 has a centerline C1. As illustrated, the central support 32 extends along the centerline C1.

A plurality of fins 34 extend radially outwardly from the central support. In the embodiment illustrated, there are four fins spaced approximately ninety (90) degrees apart from one another about the central support 32. Referring to FIG. 3, in this arrangement, pairs of fins 34 are arranged in opposing fashion.

The fins 34 are generally elongated plate-like elements. Each fin 34 has a first or distal end 36 (when viewed looking along a shaft as described below) and a second or proximal end 38. Each fin 34 extends outwardly from the central support 32 generally perpendicular thereto, positioned in a single plane.

A base 40 is provided at the second end 38 of the fins 34. In one embodiment, the base 40 comprises a generally circular disc extending outwardly from the central support 32 and attached to one or more of the fins 34. The base 40 serves one or more functions, such as supporting and connecting functions. As illustrated, the base 40 serves to connect the second ends 38 of the fins 34 and support them by limiting their movement. It will be appreciated that the base 40 may have a variety of configurations other than a disc, such as being of other shapes, and need not be solid. In one or more embodiments, the base 40 may be omitted entirely.

In general, the drive adaptor 24 is a means by which rotation of the body 22 (and thus an attached roller cover 28) may be effectuated. In the embodiment illustrated, the drive adaptor 24 comprises a shaft 42 extending from the body 22 in a direction opposite the fins 34 from the base 40. The shaft 42 has a first end 46 which is connected or connectable to the body 22 of the apparatus 20. The shaft 42 has a second, free end 44 adapted for connection to a drive.

As provided above, at least a portion of the body 22 is adapted to fit within the hollow central section 26 of the tube 30 of a roller cover 28. In this regard, the fins 34 are arranged so that the distance between outer edges of opposing fins 34, in relationship to the inside diameter of the tube 30, permits a portion of the fins 34 (between the first and second ends 36,38) to fit within the tube 30 of the roller cover 28. Preferably, the distance (through the centerline C1) from the outer edges of opposing fins 34 at one or more locations, preferably including the first end 36, is slightly less than the inside diameter of the tube 30.

As may be appreciated, roller covers 28 may have a wide variety of different diameters and lengths. Commonly, however, the interior diameter of most roller covers 28 is standardized at about 1.5 inches to permit most roller cover handles to be used in association therewith. Roller covers generally vary from about 4–18 inches long, and are most commonly about 9 inches long.

It is preferable that when the body 22 is inserted into the tube 30 of the roller cover 28 sufficient friction exists between the fins 34 and the tube 30 such that rotation of the body 22 results in rotation of the roller cover 28 to which it is mated, even when the roller cover 20 is being rotated in a cleaning solution. In one or more embodiments, as described in greater detail below, such a result is produced by having the distance (through the centerline C1) from the outer edges of opposing fins 34 at one or more locations be slightly more than the inside diameter of the tube 30. Thus, on the one hand, the body 22 must be arranged to permit its insertion into the roller cover 28 (i.e. an "insertion" function, such as by appropriately sizing the body 22) and on the other be arranged to securely engage the cover 28 (i.e. an "engaging" function).

Figure 2:
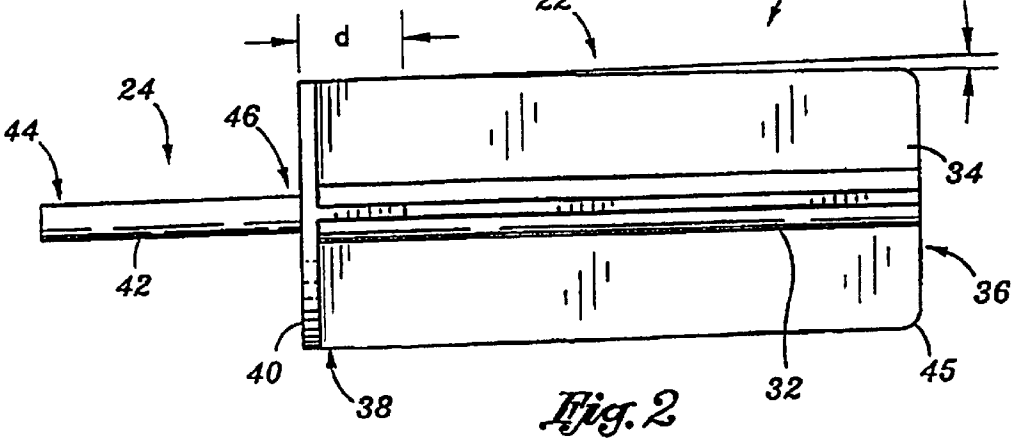
FIG. 2 is a side view of the roller cover cleaning apparatus illustrated in FIG. 1.

In the embodiment apparatus 20 illustrated in FIG. 2, these functions are facilitated by a tapered arrangement of the fins 34. In order to facilitate insertion of the body 22 of the roller cover 20, the dimension of the fins 34 at their first ends (i.e. at the first end 36 of the body 22) is such that the distance between outer edges of opposing fins 34 is slightly less than the inner dimension or diameter of a roller cover 28. The distance that the fins 34 extend outwardly gradually increases moving from the first to the second end 36,38 of each fin 34. Preferably, the fins 34 extend outwardly a maximum distance from the central support 32 along a length "d" from the second end 38 towards the first end 36 thereof. In the arrangement described, the outer edge of each fin 34 is generally parallel to the central support 32 along the distance "d" near the base 40, and tapers at an angle $\alpha$ (as compared to a line extending parallel to each fin 34 at its second end 38 and the centerline C1) inwardly towards the first end.

The distance "d" may vary dependent upon a wide variety of factors. In an embodiment where the body 22 is constructed from a relatively rigid material, a balance is preferably struck between providing at least a minimum area of the body 22 which engages the roller cover 28 to effect rotation, and not having too large of an engaging area such that the body 22 is difficult to insert into and remove from the roller cover 28. The minimum amount of body 22 which must engage the roller cover 28 is dependent upon a number of factors primarily relating to the frictional engagement of the body 22 and roller cover 28. For example, if the interior of the tube 30 the roller cover 28 is very smooth and the portion of the body 22 which is to engage it also relatively smooth (i.e. low coefficients of friction), a much larger contact area must be provided to generate the necessary frictional force to oppose relative rotation of the roller cover with respect to the body 22 during cleaning. On the other hand, if the interior of the tube 30 of the roller cover 28 is very rough and/or the portion of the body 22 which engages it is relatively rough (i.e. high coefficient of friction), then the contact area may be smaller.

A factor which is related to the necessary contact area is the force generated by the body 22 against the roller cover 28 when inserted into the roller cover. In general, the larger the contact force, the smaller the contact area which is necessary to ensure the roller cover does not move with respect to the body 22. As may be appreciated, if the enlarged area of the body 22 is large enough that it is very difficult to insert and a substantial force is generated outwardly by the body 22 against the roller cover 28 when inserted, then the contact area may be relatively smaller and/or the coefficient of friction relatively less than in a situation where the contact force is small.

As described below, in one or more embodiments, all or substantially all of the body 22 or a length thereof may engage the roller cover 28. For example, if the body 22 or a portion thereof is arranged to yield when inserted into the roller cover, then the entire length of the body 22 may be inserted into the roller cover 28 and be arranged to contact the roller cover 28.

Those of skill in the art will appreciate that the engagement area is defined partly by the shape of the body 22. For example, in the arrangement illustrated, only a portion of the edges of the fins 34 engage a roller cover 28 when the body 22 is inserted. To generate the required engagement function, the contact area (as defined by the length of the edges of the fins 34 that must contact the tube 30 of the roller cover 28 when inserted depends upon the number of fins 34 contacting the tube 30 of the roller cover 28 and the width of the fin edges) and/or coefficient of friction (as defined by the fin material, edge structure and the like) and/or biasing force (as generated by the interference fit of the body 22 into the cover 28) may be varied.

In the embodiment illustrated, the distance "d" may be as small as about 0.25 inches or less. Preferably, the angle $\alpha$ is relatively small, such as between about 2 and 10 degrees, and more preferably about 4–6 degrees. In an embodiment where the maximum distance the fins 34 extend outwardly from the central support 32 is about 0.75 inches from the central axis C1, and the length of each fin 34 from end to end is about 3–4 inches, then the fins 34 may extend outwardly from the central axis C1 at their first end 36 by about 0.72–0.73 inches (i.e. about 0.02–0.03 inches less than at their second ends). Understanding the function and arrangement of the apparatus 20 as described above, it will now be appreciated that the distance d depends on many factors such as flexibility of the material forming the fins 34 and the size of the roller cover into which the apparatus 20 is to be placed, among others.

In one or more embodiments, the maximum distance by which each fin 34 extends outwardly is such that the distance from the outer edges of opposing fins 34 is greater than the interior dimension of the tube 30 of most roller covers 28. This arrangement ensures that when the body 22 of the apparatus 20 is inserted into a roller cover 28, somewhere between the first and second ends 36,38 of the fins 34, the fins 34 will engage the tube 30 of the roller cover 28 (as the body 22 is inserted and moved inwardly, the exterior dimension thereof increases).

In one or more embodiments, the point or area at which the fins 34 extend outwardly their maximum distance may be positioned between the first and second ends 36,38, with each fin 34 extending outwardly some distance less than the maximum distance at the first and second ends 36,38. In such an arrangement, the base 40 may also have a maximum outer dimension more or less than that of each fin 34. For example, the second end 38 of each fin 34 and the base 40 may extend outwardly from the centerline C1 by about 0.74–0.75 inches, the first end of each fin 34 about 0.73–0.74 inches, and there between each fin 34 may extend outwardly a maximum distance of about 0.75 inches. In the illustrated arrangement where the point at which each fin 34 extends outwardly a maximum distance between its ends, it is still desired that the point of maximum outward extension for each fin 34 be near the second end 36 thereof. For example, when the fins 34 are about 3–4 inches, the point of maximum outward extension may be about 0.5 inches from the second ends 38 thereof.

In the above-described arrangement, each fin 34 is preferably relatively rigid. It is preferred that both "pairs" of opposing fins be similarly constructed so that when inserted into a roller cover 28, all four fins 34 engage the cover 28. In one or more embodiments, it is possible to arrange opposing pairs of fins with differing dimensions.

To also facilitate insertion of the body 22 into the roller cover 38, corners 45 of the fins 34 at their first ends 36 are rounded and generally smooth. The remainder of the edges may be smooth or rough (such as serrated), depending upon the required engaging function.

The length of the body 22 of the roller cover cleaning apparatus 20 may vary. In one or more embodiments, the length of the contacting portion of the body 22, that being each fin 34 from its first end 36 to its second end 38, is about 3–4 inches. It has been found that such a length is sufficient for use with roller covers having a wide variety of lengths, including roller covers having the generally standard length of about 9 inches long.

Preferably, the shaft 42 extends at least about 9–21 inches outwardly from the body 22. The length of the shaft 42 is primarily dependent upon the length of the shaft 42 which is necessary for engagement with the drive mechanism, and upon the desired spacing between the drive mechanism and the body 22 (as described below, while the body 22 may be entirely submerged in a cleaning material, it may not be desirable to also submerge the drive mechanism).

The roller cover cleaning apparatus 20 of the invention may be constructed of a variety of materials. In one or more embodiments, the body 22, including the fins 34, central support 32 and base 40, are all molded from a durable synthetic material such as plastic. The body 22 may, however, be constructed of wood, metal, or other synthetic or natural materials as will be appreciated by those of skill in the art. Preferably, the shaft 42 is constructed of metal or a similar durable and strong material. The shaft 42 may be constructed of plastic or other materials.

In one or more embodiments, where the shaft 42 is constructed of metal and the body 22 of plastic or a similar material, one end of the shaft 42 may be knurled or otherwise provided with a non-smooth surface for engagement with the material of the body 22. In one embodiment, the central support 32 may be generally solid but have a bore in an end thereof into which the shaft 42 may be inserted. Of course, the shaft 42 may be connected to the body 22 in a wide variety of manners. The shaft 42 may also be formed integrally with the body 22 depending on the method of manufacture (i.e. casting, molding).

In one or more embodiments, the "insertion" and "engagement" functions are facilitated by the fins 34 being slightly flexible. If flexible, the fins 34 may actually extend outwardly from the central support 32 a distance which causes interference with the tube 30 of the roller cover 28 into which it is to be inserted. In that event, however, the body 22 may be "force-fit" into the roller cover 28 with the fins 34 yielding, such as by flexing or bending, to permit their insertion into the tube 30.

It will also be appreciated by those of skill in the art that there need not be four fins. For example, there may be as few as one or greater than four. In an arrangement where there is only a single fin, then the fin is sized so that an outer edge of the fin and an opposing surface of the central support engages the roller cover 28. It is preferred that when the body 22 is inserted into the roller cover 28, the centerline C1 of the body 22 and the axis C2 of the roller cover 28 generally align. In this manner, when the body 22 is rotated, it rotates about a common axis with the roller cover 28, preventing wobbling and the like of the roller cover 28. It is possible for the centerline C1 of the body 22 to not be aligned with the axis C2 of the roller cover 28, or for the body 22 to not be rotated about its centerline (such as by offsetting the shaft 42). In such event, the roller cover 28 will not rotate evenly and may splash cleaning fluid and the like, and the cleaning effect may be substantially less than optimum. In the above description, the centerline C1 of the body 22 generally means a line passing longitudinally through the body midway between its outermost radial extremes. Preferably, this centerline C1 also passes through the center of gravity of the body 22.

In this regard, it is also preferable that the apparatus 20 be self-aligning such that when inserted, the centerlines are aligned and remain aligned. This serves to ensure that during cleaning the roller cover 28 does not vibrate or wobble excessively, which might result in substantial splashing of the user and the like. In the above-described embodiment, the slight angle of taper serves to aid in this alignment function. Those of skill in the art will appreciate that off-center connection and/or rotation may still facilitate adequate cleaning of the roller cover, but such may be associated with the above-referenced detriments of splashing and the like. It has been found generally, that if the rotation is extremely off-center as to the roller cover 28, the roller cover 28 tends to act as a paddle and "stir" the cleaning fluid instead of rotating within it, thus lessening the cleaning effect (as described below, cleaning effect is substantial as a result of a shearing generated by movement of the roller cover relative to the cleaning fluid). Nonetheless, such configurations are contemplated as within the scope of the present invention.

The fins 34 also need not be arranged so that they are in opposing positions. For example, the connection points of the fins 34 may be offset from one another. In the arrangement where there are three fins, the fins may be spaced one-hundred and twenty (120) degrees apart and thus not have opposing mates.

As stated above, the base 40 of the body 22 primarily provides a reinforcing or supporting function, aiding in retaining the fins 34 fixed in their positions. If the fins 34 are sufficiently rigid (or if arranged to "yield" to engage the roller cover), the base 40 may be omitted entirely.

The base 40 may also aid in aligning the body 22 in the roller cover 28 if the roller cover permits insertion of the body 22 therein a sufficient distance. In one or more embodiments, the base 40 may serve a stop function. In such arrangement, it is desirable for the base 40 to have an outer dimension larger than that of the fins 34. As noted above, the base 40 need not be circular. For example, the perimeter shape of the base 40 may be oval, square, or irregular.

Figure 4:
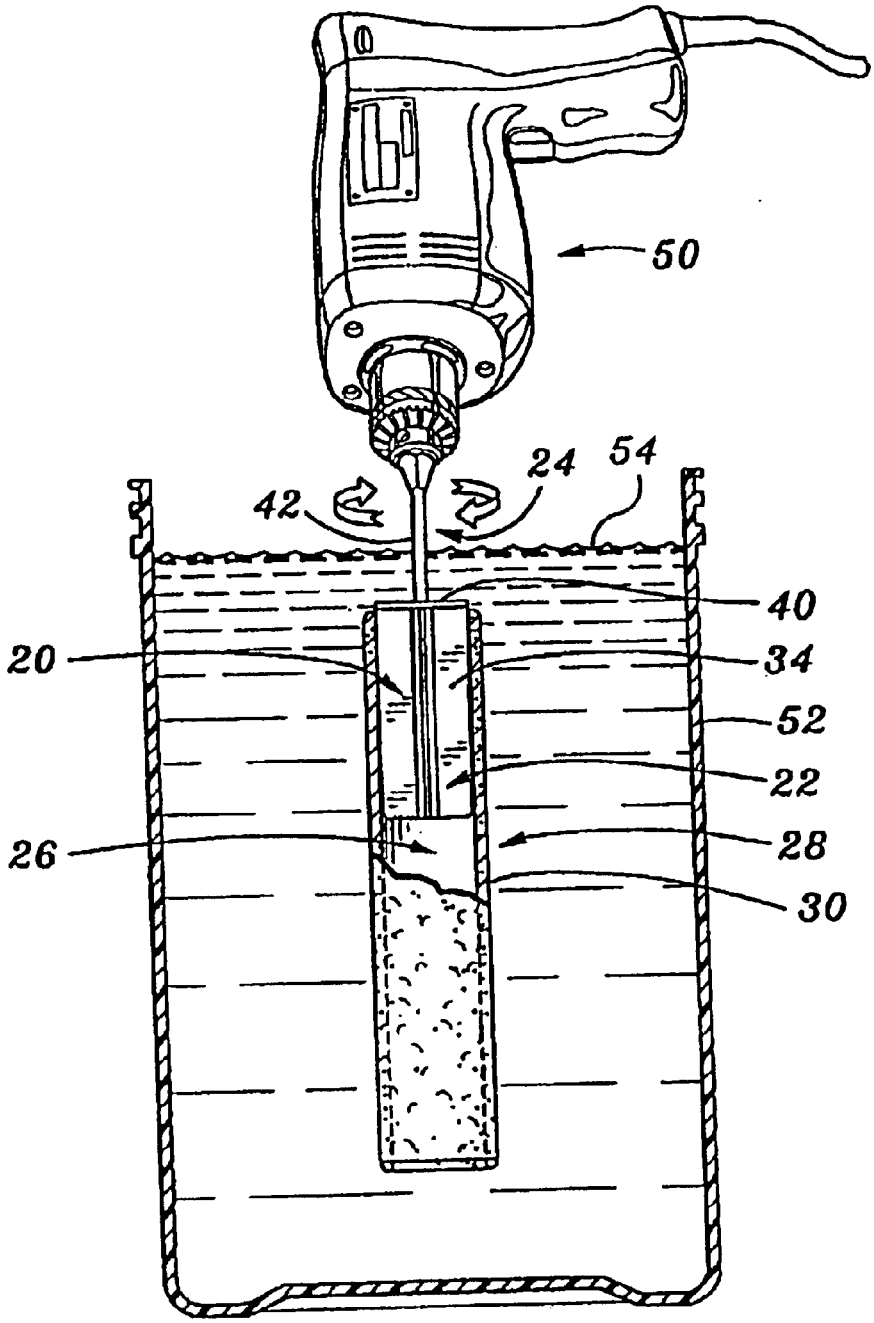
FIG. 4 illustrates a method of cleaning a roller cover utilizing the roller cover cleaning apparatus illustrated in FIG. 1.

Referring to FIG. 4, a method of cleaning a roller cover in accordance with the invention will be described. The body 22 of the roller cleaning apparatus 20 is engaged with the roller cover 28 to be cleaned. In the arrangement of the body 22 described above, this step comprises inserting the body 22 into the central hollow area of the tube 30 of the roller cover 28.

Next, a drive apparatus is engaged with the drive adaptor 24 of the roller cover cleaning apparatus 20. In the embodiment illustrated, this comprises engaging the shaft 42.

Preferably, the drive apparatus comprise a rotary drive mechanism 50. The rotary drive mechanism 50 may be a manual or power operated device. In the embodiment illustrated, the rotary drive mechanism 50 comprises a electrically powered drill. In such an arrangement, the free or second end of the shaft 42 is engaged with the chuck of the drill.

The roller cover 28 is then placed in a cleaning solution and rotated. In a preferred arrangement, the roller cover 28 is placed in a container 52 containing cleaning solution. The container 52 may comprise a wide variety of elements, such as a bucket, sink or the like. Preferably, the container 52 is large enough to retain sufficient cleaning solution that an entire roller cover 28 can be submerged in the cleaning solution.

As will be appreciated by those of skill in the art, the cleaning solution will depend upon the material which is to be cleaned from the roller cover 28. For example, water may comprise the cleaning solution if water-based latex paint is to be cleaned from the roller cover 28. Mineral spirits may comprise the cleaning solution if oil-based paint or similar material is to be cleaned from the roller cover 28.

Cleaning of the roller cover 28 is effectuated as a result of the rotation of the roller cover 28 within the cleaning solution. It has been found that rapid, thorough cleaning of the roller cover is achieved as a result of several actions. First, the rotation of the roller cover in the cleaning solution relative to the cleaning solution results in a shearing effect: molecules of cleaning fluid impact the roller cover and the coating material therein. The molecules of cleaning fluid then bond to and break the coating material loose from the roller cover. Moreover, the centrifugal force results in the coating material being drawn outwardly away from the roller cover and into the cleaning solution. As a result of these actions, the coating material is effectively and completely removed from the roller cover in a short period of time.

It has been found that a roller cover may be completely cleaned in as little as 10 seconds to 1–3 minutes depending upon a number of factors such as the coating material which was being applied with the roller cover, the saturation of the coating material into the roller cover, the material from which the roller cover is constructed, the rate at which the roller cover is rotated. In general, it has been found that the time which is required to clean a roller cover in accordance with the method of the invention is a fraction of the time (such as an order of magnitude less) a user would spend cleaning a similar roller cover (considering construction material, coating applied, etc.) using a messy, slow and ineffective hand-cleaning method. Moreover, even after a user spends a significant amount of time and effort using the hand-cleaning method to reach a point at which the user believes the roller cover to be clean, the roller cover is generally much less clean than it would have been if cleaned for a much shorter duration in accordance with the method and apparatus of the invention.

Because of the short cleaning time, the roller cover is not exposed to the cleaning solution for a duration which may significantly degrade (such as in the case of water-logging cardboard or destruction of other support tubes/roller cover fibrous material) the roller cover.

As another aspect of the invention, once clean, the roller cover may be quickly dried. In particular, once clean, the user may remove the roller cover from the cleaning solution and rotate it in the air. When rotated at high speed, the roller cover is quickly dried. This avoids rotting, matting and hardening of the roller cover which may result in prior art arrangements where the roller cover is stored or put away wet. In the prior art, when a roller cover is cleaned and then stored, remaining cleaning solution and coating material flows with the aid of gravity to a bottom portion of the roller cover. At the next use, one portion of the roller cover generally then has an area of dried coating material thereon. In accordance with the method of cleaning and drying of the present invention, this problem is alleviated. Because the roller cover is dried, the cover can immediately be used again, such as to apply to different color of paint.

The method of cleaning and drying in accordance with the invention has numerous benefits over the prior methods of cleaning. A substantial advantage is that the user does not need to work the roller cover during cleaning, keeping the user's hands clean and out of the cleaning solution. The method does not require a stream of water or a drain (such as a hose or sink). The method of cleaning may be accomplished with a small container of cleaning fluid which may be easily transported. Because of the self-aligning function and rotation on-center of the roller cover 28, there is essentially no splashing or the like during use even at high rotational speeds, freeing the user from mess.

It has been determined that for the best results, the rotational speed of the roller cover 28 should preferably be more than 150–500 revolutions per minute (rpm) and more preferably 800–2000 or more rpm. In the arrangement illustrated, a high speed drill 50 is provided for this purpose. Of course, the rotation of the apparatus 20 with the roller cover 28 thereon may be achieved manually, such as by attachment of a hand-cranked rotary drive device. Preferably, however, the speed of the rotation is as provided above to achieve the maximum cleaning effect in the shortest duration.

The drive adaptor 24 may comprise a wide variety of elements other than those described above. In one or more embodiments, the drive adaptor 24 may comprise a pulley member connected to the body. The pulley may then be driven by a motor or other drive, such as with a belt or other element. In one or more embodiments, the drive adaptor 24 may comprise a friction disc mounted to the body. In such event, the drive mechanism may comprise a friction disc mounted on a rotary drive (such as a pad on an output shaft) for engagement with the friction disc for driving the body in a "clutch"-type manner. In one or more embodiments, the drive adaptor 24 may comprise one or more teeth extending from (or notches in) the body for engagement with teeth or similar members associated with a drive. It may be understood that the drive adaptor 24 may be an element separate from the body (such as a shaft connected to the body) or may comprise a portion of the body itself, such as a gear teeth.

It will also be appreciated that the means for driving the apparatus 20 may comprise a wide variety of mechanisms. In general, the drive mechanism may comprise a wide variety of known methods and systems for imparting rotary motion (directly or indirectly) to an item.

Figure 5:
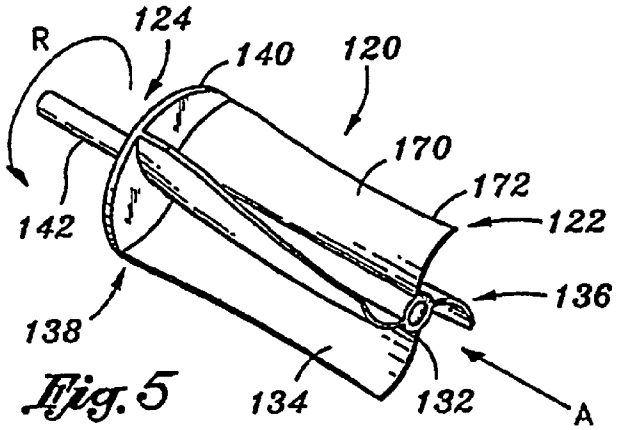
FIG. 5 is a perspective view of a roller cover cleaning apparatus in accordance with another embodiment of the invention.
Figure 6:
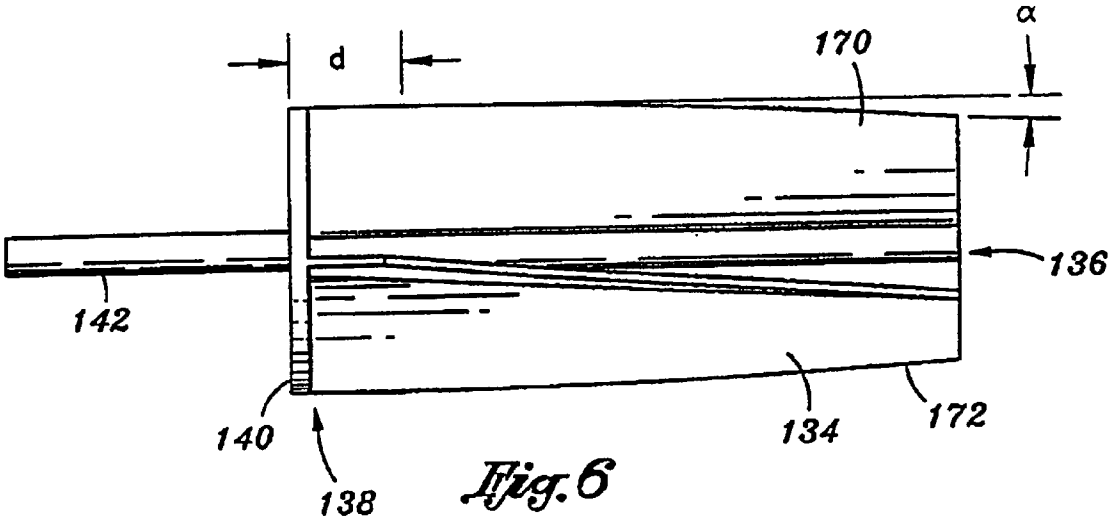
FIG. 6 is a side view of the roller cover cleaning apparatus illustrated in FIG. 5.
Figure 7:
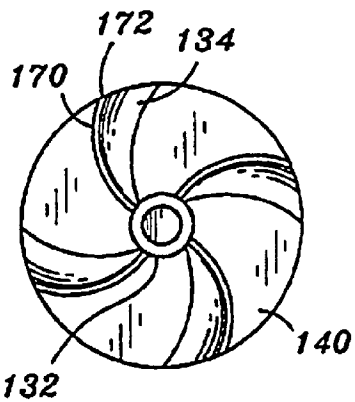
FIG. 7 is an end view of the roller cover cleaning apparatus illustrated in FIG. 5.

A roller cover cleaning apparatus 120 in accordance with another embodiment of the invention is illustrated in FIGS. 5–7. This embodiment roller cover cleaning apparatus 120 is similar to the last embodiment, including a body 122 and drive adaptor 124. The body 122 includes a central support 132, base 140, and one or more fins 134.

In this embodiment, each fin 134 is not positioned in a single plane perpendicular to the central support 132. Instead, each fin 134 is twisted, having a first end 136 which is offset from a second end 138. In one or more embodiments, it is desired that the fins 134 twist in a clock-wise direction when viewed in a direction A as illustrated in FIG. 5. In this arrangement, each fin 134 has a convex front surface 170 and an outer edge 172.

As illustrated, the second end 138 of each fin 134 generally extends perpendicular to the base 140 and the central support 132 for some distance. Thereafter, the fin 134 begins to twist. In one or more embodiments, the fins 134 may begin to twist immediately from the base 140.

In one or more embodiments, the maximum distance that the fin 134 extends radially outwardly from the central support 132 reduces in accordance with an angle $\alpha$ in similar fashion to the embodiment illustrated in FIG. 2 and described above. In the embodiment illustrated, a portion of each fin 134 extends outwardly the maximum distance. As illustrated, this portion is a distance "d" of each fin 134. Similar to the embodiment described previously, this distance "d" may vary dependent upon a wide variety of factors.

In one or more embodiments, the fins 134 may be arranged to extend outwardly the maximum distance along their entire length. In such an embodiment, the fins 134 are preferably constructed to yield (such as by being constructed of a somewhat pliable material) when inserted into a roller cover.

In this embodiment of the invention, the "insertion" function is facilitated by the taper of the fins 134. The "engagement" function is not only facilitated by the taper of the fins 134, but a locking effect is achieved as a result of the twisted or serpentine shape of the fins 134.

Use of this embodiment roller cover cleaning apparatus 120 is similar to that described above and as illustrated in FIG. 4. Advantageously, in accordance with this embodiment, the rotary drive device may be used to insert the apparatus 120 into the roller cover. In particular, a user may place the first end 136 of each fin 134 slightly into a roller cover. Then the user may use the rotary drive device to "thread" the apparatus 120 into the roller cover. Preferably, the user rotates the apparatus 120 in a clock-wise direction when viewed from the free end of the shaft 142 looking towards the body 122, i.e. opposite the direction of the twist of the fins (see FIG. 7). The convex front faces 170 of the fins 134 comprise the leading surface in this direction of rotation, sliding easily around and into the roller cover until the increased dimension of the fins 134 causes them to bind into the roller cover.

As in the previous embodiment, there may be as few as one fin or more than four. The exact positions of the fins 134 may also vary from that illustrated. The base 140 may, as described above, be shaped different and be of differing sizes. In fact, the base 140 may be omitted entirely, especially if the fins 134 are constructed to be sufficiently rigid.

In one or more embodiments, in use, the apparatus 120 may be rotated in an opposing direction when being inserted into/removed from a roller cover. In such event, there is some risk that the edge 172 of each fin 134 will catch or bind on the interior surface roller cover and damage it. To reduce the risk of such occurrence, the outer edge 172 of each fin 134 may be rounded.

In one or more embodiments, the fins 134 may "twist" in a direction opposite to that illustrated in FIGS. 5–7. In such event, it is desirable for a user to rotate the apparatus 120 in the opposite direction to insert/remove it (i.e. rotate counter-clockwise).

Figure 8:
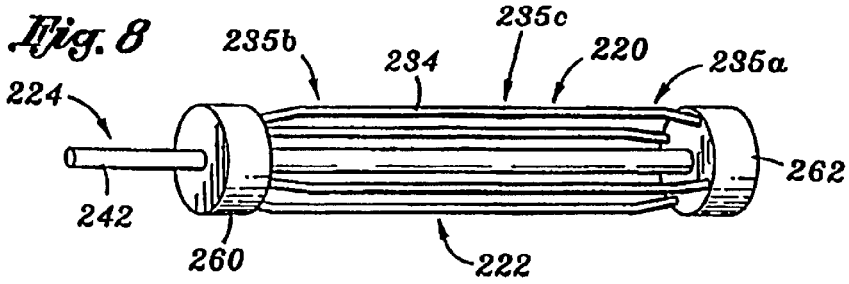
FIG. 8 is a perspective view of a roller cover cleaning apparatus in accordance with another embodiment of the invention.
Figure 9:
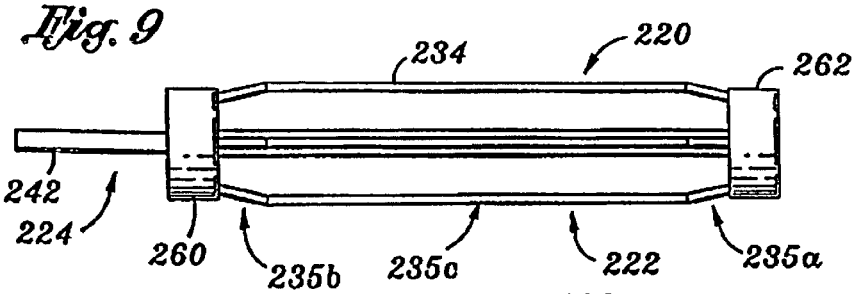
FIG. 9 is a side view of the roller cover cleaning apparatus illustrated in FIG. 8.

A roller cover cleaning apparatus 220 in accordance with another embodiment of the invention is illustrated in FIGS. 8 and 9. This embodiment apparatus 220 again has a body 222 for engaging a roller cover (not shown) and a drive adaptor 224 for use in driving the apparatus 220.

In accordance with this embodiment, the drive adaptor 224 again comprises an elongate shaft 242. The body 222 comprises first and second mounts 260,262 positioned on the shaft 242. As illustrated, the first and second mounts 260,262 comprise generally circular disc elements. The mounts 260,262 are securely connected to or at least connectable to the shaft 242 in a manner such that when the shaft 242 rotates, the mounts 260,262 connected thereto also rotate.

The body 222 also includes a plurality of rods 234 extending between the mounts 260,262. The rods 234 comprise somewhat flexible members. In accordance with this embodiment of the invention, the "insertion" and "engagement" functions are facilitated by the rods 234, which are arranged to yield, permitting insertion thereof into a roller cover, but which are also arranged to generate a sufficient biasing force to press against and engage the inside of the roller cover.

In one or more embodiments, each rod 234 has a first end 235*a*, a second end 235*b* and a center section 235*c*. The first and second ends 235*a,b* of each rod 234 extend from respective mounts 260,262 at an angle up and away from the shaft 242. The center section 235*c* extends generally parallel to the shaft 242 between the first and second ends 235*a,b*. Preferably, each center section 235*c* is positioned a radial distance outwardly from the shaft 242 a distance greater than the radius of a roller cover into which the apparatus 220 is to be inserted. In other words, when the apparatus 220 is inserted into a roller cover, there is a slight interference between the rods 234 and the roller cover. The amount of interference may be on the order of a few thousandth inches or more.

In the embodiment illustrated, the mounts 260,262 are generally circular in outer shape. This arrangement has the advantage that the mounts aid in securing a roller cover. If the mounts 260,262 have an outer dimension which is almost, but not quite as large as, the interior dimension of the roller cover, then the mounts 260,262 aid in aligning the roller cover on the apparatus 220 and reducing wobble and other problems which might arise if the roller cover is mounted thereon in an off-center arrangement. It will be appreciated that the mounts 260,262 may have a variety of other shapes and sizes. For example, the mounts 260,262 may have a square circumference, with the four corners thereof generally arranged to align and/or engage the inside of a roller cover.

It is also possible to eliminate the mounts 260,262 entirely. For example, the first and second ends 235*a,b* of the rods 234 may be directly connected to the shaft 242. Alternatively, one of the two ends of one or more of the rods 234 may be connected to a member mounted on the shaft 242, and the other end(s) mounted directly to the shaft 242.

This embodiment roller cover cleaning apparatus 220 may be constructed from a wide variety of materials. Preferably, the rods 234 are constructed of metal, such as stainless steel, so as to have the desired flexibility and bias-force generation. The rods 234 may be solid or hollow, and may be circular in shape or have a wide variety of other shapes. For example, each rod 234 may be semi-circular in shape.

It is also desirable for the shaft 242 to be constructed of metal. The mounts 260,262 may be constructed of plastic, metal or other materials.

In the embodiment illustrated, there are provided four biasing rods 234. In one or more embodiments, the apparatus 220 may be provided with as few as one, or more than four such elements. For example, the apparatus 220 may be arranged so that a single rod 234 extends outwardly from the mounts 260,262 a greater distance than the rods 234 illustrated in FIG. 5. In that case, the rod 234 and an opposing portion of the mounts 260,262 would engage the roller cover. Again it is desirable that the axis of rotation of the apparatus 220 align with the central axis through the roller cover.

Use of the roller cover cleaning apparatus 220 in accordance with this embodiment is similar to that of the first embodiment, as illustrated in FIG. 4. In this embodiment, the body 222 is inserted into the hollow central section of the roller cover, with the rods 234 being "press-fit" therein and engaging the roller cover. Thus, when the apparatus 220 is rotated, the roller cover mounted thereto also rotates.

Figure 10:
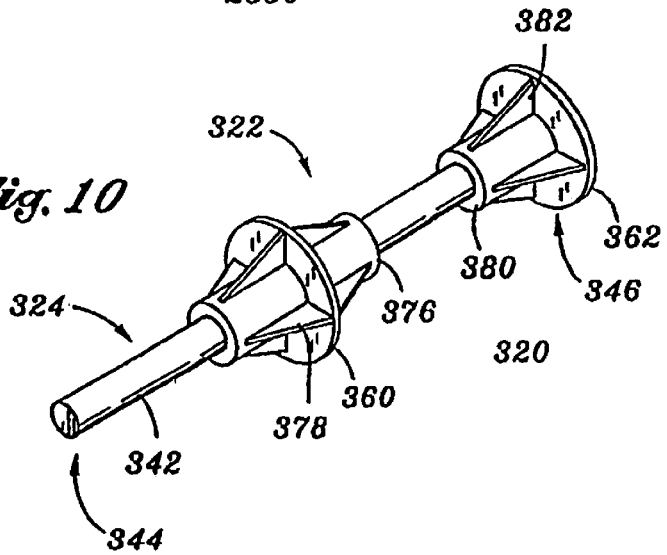
FIG. 10 is a perspective view of a roller cover cleaning apparatus in accordance with another embodiment of the invention.
Figure 11:
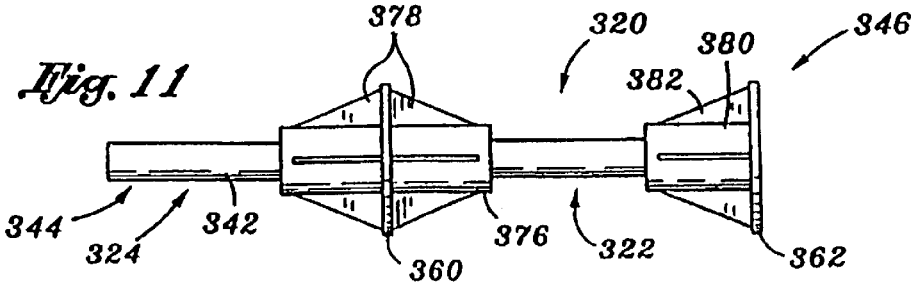
FIG. 11 is a side view of the roller cover cleaning apparatus illustrated in FIG. 10.

A roller cover cleaning apparatus 320 in accordance with another embodiment of the invention is illustrated in FIGS. 10 and 11. This embodiment roller cover cleaning apparatus 320 again comprises a body 322 for engaging at least a portion of a roller cover (not shown), as well as a drive adaptor 324.

Like the previous embodiment, the drive adaptor 324 comprises an elongate shaft 342. The body 322 comprises two generally circular discs 360,362 mounted on the shaft 342. As with the previous embodiment shafts 342, this shaft has a free end 344 for connection to a drive, and an opposing second end 346. As illustrated, one disc 362 is positioned at the second end 346 of the shaft 342. The other disc 360 is positioned along the shaft 342 between the second end 346 and the free end 344 of the shaft 342. Preferably, the first and second discs 360,362 are spaced apart by about 1–6 inches.

Each disc 360,362 has a generally circular outer circumference. A portion of each disc 360,362 is preferably slightly smaller than an interior diameter of a roller cover into which the discs 360,362 are to be inserted. Preferably, at least a portion of the disc 360 nearest the free end 344 of the shaft 342 is slightly larger than the interior diameter of a roller cover into which it is inserted, so as to provide an engaging function. In one embodiment, the diameter of the disc 360 increases when moving from a front edge thereof closest to the disc 362 in the direction of the free end 344 of the shaft 342. In one or more embodiments, one or both discs 360,362 may have a diameter larger than the interior of the roller cover, but be constructed to yield sufficiently to be inserted into the roller cover. The outer edge of each disc 360,362 may be smooth or rough (such as serrated).

As illustrated, a first disc 360 is generally mounted centrally on a sleeve 376. The sleeve 376 is generally tubular, having a central bore through which the shaft 342 passes. Preferably, the sleeve 376 is mounted to shaft 342 in a manner which prevents relative rotation thereof. In one or more embodiments, the sleeve 376 may be glued, contraction cooled or otherwise secured to the shaft 342.

One or more ribs 378 extend upwardly from the sleeve 376 to the disc 360. The ribs 378 may be of a variety of shapes, and are arranged to reinforce the disc 360 to prevent its movement and help engage the roller cover. As illustrated, four ribs 378 are spaced equidistantly about each side of the disc 360.

The second disc 362 is preferably mounted to a sleeve 380. Preferably, the disc 362 is positioned at an end of the sleeve 380. The sleeve 380 preferably has a bore therethrough (either completely or just partially) for accepting the shaft 342. As described above, it is desirable for the sleeve 380 to be secured to the shaft 342 in a manner which prevents the relative rotation thereof.

Once again, ribs 382 preferably extend between the disc 362 and sleeve 380 for reinforcing the disc 362 and/or engaging the roller cover. As illustrated, four ribs 382 are spaced equidistantly about the sleeve 380.

The shape of the discs 360,362 may be other than circular. For example, the discs may be oval. In other configurations, however, less surface area of the discs 360, 362 may engage the roller cover, increasing the possibility that the body 322 may spin inside the roller cover and not fully engage and rotate the roller cover for maximum effect.

Use of the roller cover cleaning apparatus 320 in accordance with this embodiment is similar to that of the first embodiment, as illustrated in FIG. 4. In this embodiment, the body 322 is inserted into the hollow central section of the roller cover. In particular, the discs 360,362 are pressed into the roller cover until at least one disc (or its associated rib(s)) engages the roller cover.

Because of variations in the surface texture and the interior shape of the roller cover, the generally circular discs 360,362 and/or one or both ribs 378,382 securely engage the roller cover. Thus, when the apparatus 320 is rotated, the roller cover mounted thereto rotates as well.

In the embodiment illustrated, the spacing of the two discs 360,362 aids in retaining the shaft 342 centered along the axis through the roller cover, reducing wobbling and the like of the roller cover when rotated. In this regard, it should be appreciated that the position of the discs 360,362 may vary from that illustrated. For example, the second disc 362 need not be positioned at the second end 346 of the shaft 342.

In one or more embodiments, greater than two discs may be provided on the shaft 342 to aid in gripping and aligning the roller cover. Alternatively, in one or more embodiments, there may be only a single disc provided on the shaft 342. In one or more embodiments, in a single disc arrangement the disc may be modified to be wider so as to engage a greater surface area of the roller cover. Alternatively, or in addition, one or more ribs may extend radially outwardly from the sleeve 376,380 and/or shaft 342 the same radial distance as the disc in either (or both) directions, for some axial distance. In such an arrangement, the rib(s) would function similar to the fins of the embodiment roller cover cleaner 20 described above and illustrated in FIG. 1.

Figure 13:
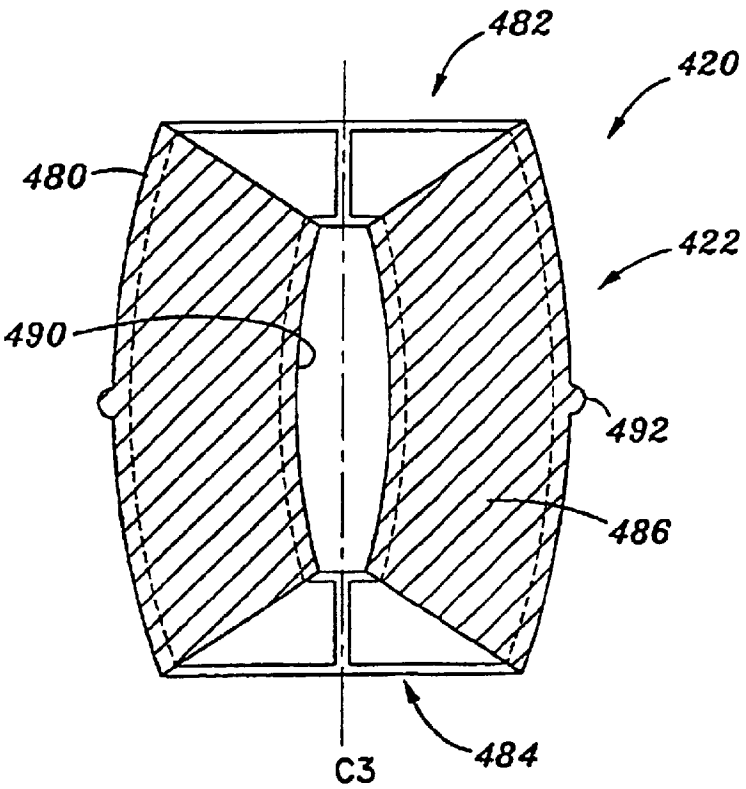
FIG. 13 is a cross-sectional view of the roller cover cleaning apparatus illustrated in FIG. 12 taken along line 13—13 therein.
Figure 12:
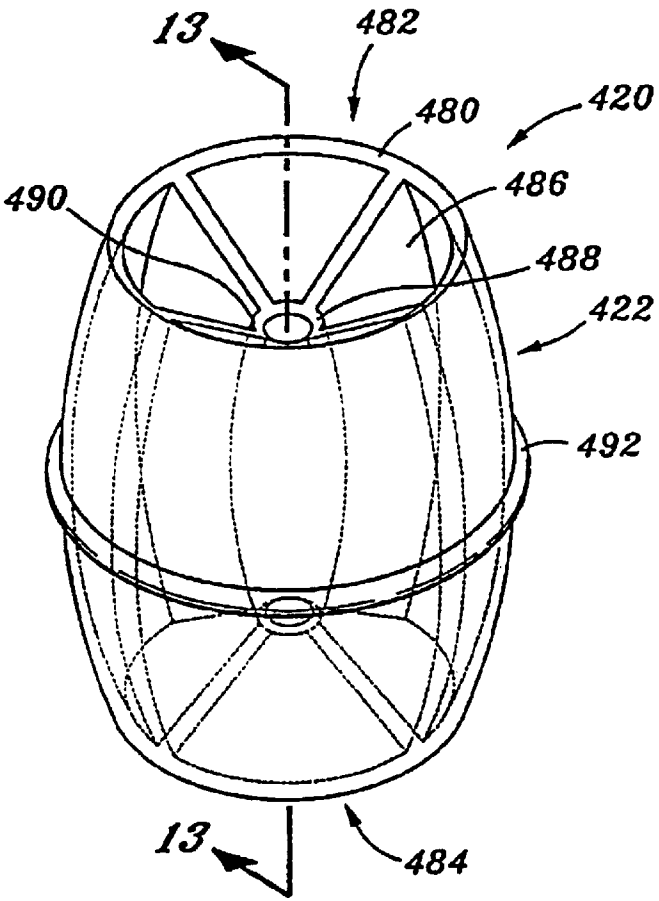
FIG. 12 is a perspective view of a roller cover cleaning apparatus in accordance with another embodiment of the invention.

A roller cover cleaning apparatus 420 in accordance with another embodiment of the invention is illustrated in FIGS. 12 and 13. This embodiment roller cover cleaning apparatus 420 again includes a body 422 and a drive apparatus (not shown).

The body 422 is generally barrel-shaped. The body 422 is defined by a wall 480 with a first end 482 and a second end 484. As illustrated in FIG. 13, a centerline C3 extends through the body 422. The wall 480 is positioned radially outwardly from the centerline C3. Preferably, the wall 480 is positioned radially outwardly from the centerline C3 by a first distance at its ends 482,484, and by an increased distance at a point or area at or between its ends.

A plurality of ribs 486 extend inwardly from the wall 480 to a central support 488. The central support 488 is generally tubular, also having a first end and a second end. As illustrated, the first and second ends of the central support 488 are inset from the first and second ends of the wall 480. The central support 488 is defined by an inner wall 490 which has a shape similar to that of the wall 480, but which is sized smaller than the wall 480. In this arrangement, the inner wall 490 of the central support 488 "bows" outwardly from the centerline C3 between first and second ends thereof.

As illustrated, four ribs 486 extend from the wall 480 to the central support 488. These ribs 486 may be spaced equidistant from one another, or spaced in other fashions. As illustrated, each rib 486 angles from the first end 482 of the wall 480 to a top end of the central support 488. Likewise, each rib 486 angles from the second end 484 of the wall 480 to the bottom or second end of the central support 488.

In one or more embodiments, a ridge 492 extends outwardly from the outer surface of the wall 480. The ridge 492 comprises a generally semi-circular raised area. In one or more embodiments, the ridge 492 extends outwardly about 0.1–1 inches and more preferably about 0.25–0.5 inches from the wall 480. The ridge 492 is preferably located near the center of the wall 480 between its first and second ends 482,484, and preferably circumscribes the wall 480.

The apparatus 420 is sized to fit within a roller cover. As such, in at least one area, the diameter of the apparatus 420 preferably exceeds the inside diameter or dimension of a roller cover in an unbiased condition, but is capable of being compressed or otherwise reduced in size to a dimension which permits its insertion into the roller cover. In the arrangement illustrated, this maximum diameter occurs at the location of the ridge 492.

As with the previous embodiments, the body 422 is arranged to facilitate the "insertion" and "engagement" functions. The "insertion" function is facilitated by the first and second ends 482,484 of the wall 480 having a reduced diameter or dimension. On the other hand, the body 422 has an area of increased dimension, in this case the area of the body 422 at the ridge 492, which is arranged to engage a roller cover when placed therein.

As in the previous embodiment, illustrated in FIGS. 10 and 11, due to surface irregularities and irregularities in the "circular" shape of the interior of the roller cover, the ridge 492 engages areas of the roller cover. Further, because of the somewhat elongate shape of the apparatus 420 and the narrow taper of the wall 480 between its center and ends, the apparatus 420 is generally self-aligning within the roller cover. This aids in the prevention of wobble of the roller cover when being rotated.

Because of the "bowed" shape of the walls 480,490, pressure generated during insertion into a roller cover may cause the walls 480,490 to flex or yield inwardly. In particular, force on the outer wall 480 is transmitted through the ribs 486 to the wall 490 defining the central support 488. Because of the shape of the wall 490, the wall 490 may collapse inwardly. This arrangement both permits the body 422 to fit within roller covers having some variance in their inner dimensions, and results in a biasing force pressing the body 422 into engagement with the roller cover.

In one or more embodiments, the apparatus 420 may be injection molded. In this arrangement, the ribs 486 may be constructed so as to be hollow and compress when subject to the insertion pressure, thereby providing the yielding effect necessary to permit insertion of the apparatus 420 in to a roller cover.

In one or more embodiments, the drive adaptor (not shown) of the apparatus 420 comprises a shaft similar to that illustrated in the previous embodiments. The shaft may be inserted into and secured to the central support 488 so that rotation of the shaft effectuates rotation of the body 422.

Use of the roller cover cleaning apparatus 420 is similar to that illustrated in FIG. 4 and described above. A user inserts at least a portion of the body 422 into a roller cover so that the body 422 engages the roller cover. The user then rotates the roller cover in a cleaning solution.

In one or more embodiments, the apparatus 420 may be modified so that it may be quickly and cheaply constructed in a blow-molding process. In such an arrangement, the body 422 may comprise a generally hollow barrel-shaped structure defined by the outer wall 480 (i.e. having no ribs 486 or central support 488). The first and/or second ends 482,484 of the body 422 may be substantially closed to define only a sleeve area through which the shaft for driving the body 422 would extend and engage the body 422.

Of course, the body 422 may be manufactured from a wide variety of materials and in a wide variety of manners. For example, the body 422 could be constructed of rubber or metal.

Alternate embodiments of the apparatus 420 are contemplated. For example, there need not be four ribs 486, but instead as few as one or more than four. The apparatus 420 may also comprise a substantially hollow shell formed by the outer wall 480 and having only an attachment point for a drive apparatus. For example, a disc-shaped element might replace the ribs 486 and central support 488, and the drive apparatus comprise a shaft centrally connected to the disc element.

In one or more embodiments, the apparatus 420 does not include a ridge 492. In one or more other embodiments, multiple ridges or other surface texture/features are provided on the outside surface of the outer wall 480 for use in engaging a roller cover. In one or more embodiments, one or more portions of the outer surface of the ridge 492 are rough, such as serrated, to aid in gripping the roller cover.

In one or more embodiments, the ridge 492 provided on the wall 480 is serpentine in shape. In such an arrangement, the ridge 492 may start near the second end 484 of the wall 480 and coil around the outside of the wall 480 towards the top end 482 thereof. In such an arrangement, the body 422 may be "threaded" into a roller cover by pressing the apparatus 420 into a roller cover while turning or twisting either the roller cover or apparatus 420.

Figure 14:
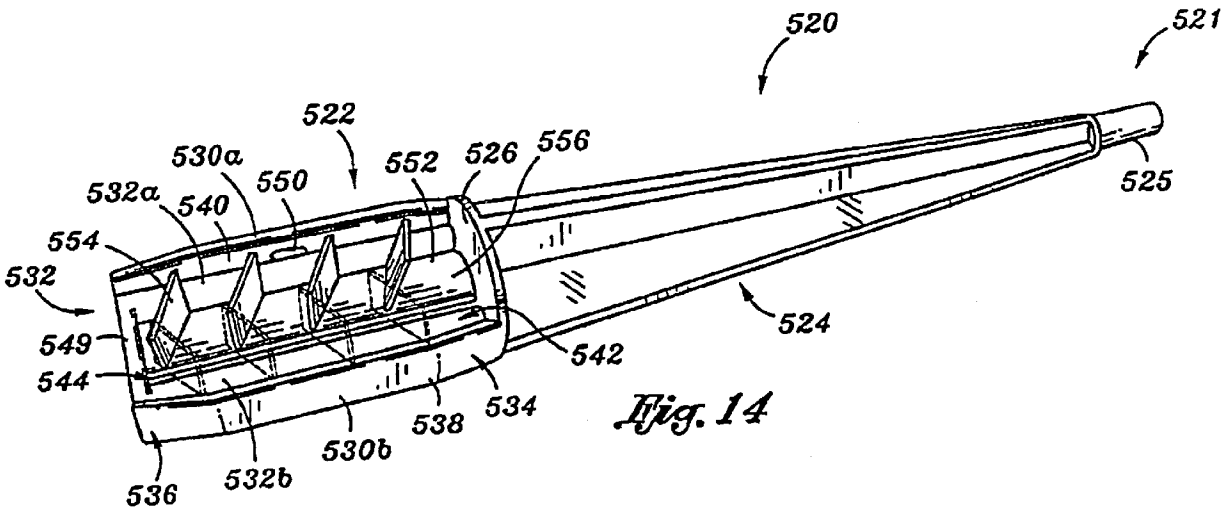
FIG. 14 is a perspective view of a roller cover cleaning apparatus in accordance with another embodiment of the invention.
Figure 16:
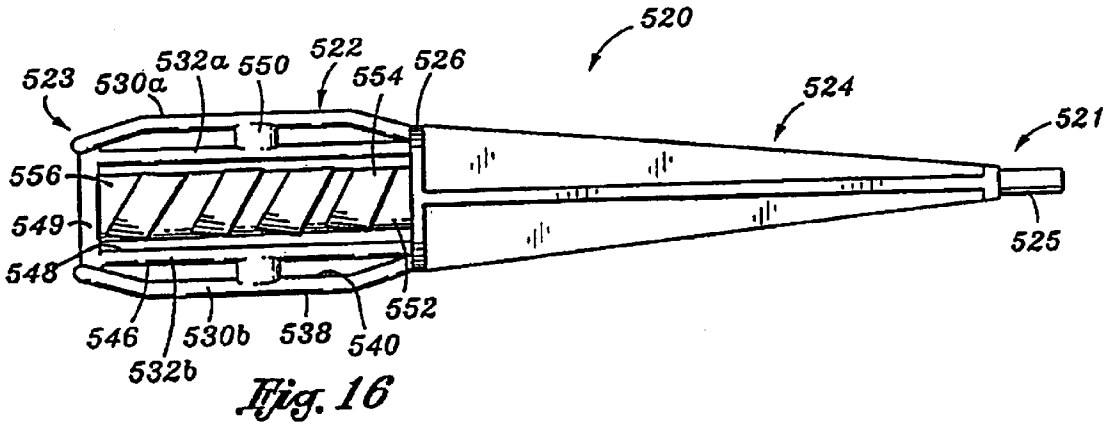
FIG. 16 is a side view of the roller cover cleaning apparatus illustrated in FIG. 14.
Figure 15:
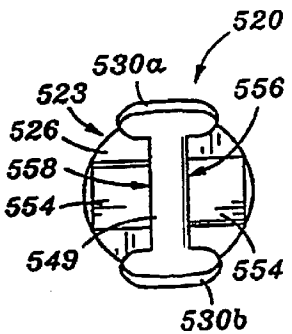
FIG. 15 is an end view of the roller cover cleaning apparatus illustrated in FIG. 14.

A roller cover cleaning apparatus 520 in accordance with another embodiment of the invention is illustrated in FIGS. 14–16. This embodiment roller cover cleaning apparatus 520 again includes a body 522 and a drive adaptor 524. The apparatus 520 has a proximal end 521 and a distal end 523.

In the illustrated embodiment, the body 522 includes a generally circular disc or support 526 between the proximal and distal ends 521,523. While the base 526 in one embodiment is a solid, generally circular member, in other embodiments the base may have any variety of peripheral shapes and need not be solid. For example, in one embodiment, the base 526 may have the form of a hoop.

In one embodiment, the drive adaptor 524 comprises a member extending outwardly from a first side of the base 526. As illustrated, this member has a "+" cross-sectional shape at its connection to the base 526. The drive adaptor 524 reduces in dimension to a chuck insert 525 at the proximal end 521 of the apparatus 520. The chuck insert 525 comprises a generally rod-like member having, in a preferred embodiment, six sides for gripping by a chuck or other drive element. As described above, the drive adaptor 524 may have a wide variety of shapes and may comprise a wide variety of elements. For example, the drive adaptor 524 may have a "Y" shape, or comprise a hollow tube or solid rod. As with the previously described embodiments, the drive adaptor 524 may generally comprise any element which is associated with the base 526 or body 522 and permits the body 522 to be driven by a drive mechanism. In one or more embodiments, the drive mechanism may comprise a rotary drive having a splined shaft. In such event, the drive adaptor 524 may comprise a bore into which the splined shaft may be placed in engagement. In another embodiment, the drive adaptor 524 may comprise an edge or face of the base 526 for driving with a belt, include teeth for engagement with a drive gear, or permit direct frictional contact with a drive disc.

In the illustrated arrangement, the "+" cross-sectional shape of main portion of the drive adaptor 524 serves to reduce the total size/volume of material necessary to form the drive adaptor 524, but still provides sufficient structural rigidity and support to transmit applied rotational force from a drive device to the body 522.

In one embodiment, a central axis extends through the apparatus 520. In a preferred embodiment, the central axis is aligned with and extends along the drive adaptor 524, and thus extends through the base 526 generally perpendicular to opposing faces thereof. In one embodiment, the central axis is co-incident with the axis of rotation of the apparatus 520 when used, as described below.

In one embodiment, the axis of rotation is not co-incident with a central axis associated with at least a portion of the apparatus 520, such as the body 522.

A pair of outer struts 530*a,b* extend outwardly from a second side of the base 526 generally perpendicular thereto. A pair of inner struts 532*a,b* also extend outwardly from the second side of the base 526 generally perpendicular thereto. In a preferred embodiment, the struts 530*a,b*, 532*a,b* extend generally parallel to the central axis.

As illustrated, the outer struts 530*a,b* are positioned at opposing sides of the base 526. In this configuration, the outer struts 530*a,b* are generally 180 degrees apart about the generally circular base 526, and thus lie generally in the same plane, but are spaced from one another. Both outer struts 530*a,b* are positioned near the outer edge of the base 526. As illustrated, the outer struts 530*a,b* are generally rectangular in shape, having a first end 534 connected to the base 526 and an opposing second end 536. Each outer strut 530*a,b* has an outer surface 538 and an inner surface 540.

The inner struts 532*a,b* are positioned adjacent to, but spaced inwardly from, the outer struts 530*a,b*. In one embodiment, the inner struts 532*a,b* are positioned radially closer to the central axis than the outer struts 530*a,b*. As illustrated, a first inner strut 532*a* corresponds to a first of the outer struts 530*a*, and a second inner strut 532*b* corresponds to a second of the outer struts 532*b*. The inner struts 532*a,b* each have a first end 542 connected to the base 526, and a second, opposing end 544. The inner struts 532*a,b* are generally rectangular in shape as well, and have an outer surface or face 546 and an inner surface or face 548. The outer surface 546 of each inner strut 532*a,b* faces the inner surface 540 of a corresponding outer strut 530*a,b*.

In a preferred embodiment, the second ends 536 of the outer struts 530*a,b* and the second ends 544 of the inner struts 532*a,b* are all connected to one another. In this manner, these ends of the outer struts 530*a,b* and inner struts 532*a,b* are prevented from moving with respect to one another. In one embodiment, an end connector 549 extends between the second ends 536 of the outer struts 530*a,b* and is connected to the second end 544 of each inner strut 532*a,b*. The ends of the outer struts 530*a,b* and inner struts 532*,a,b* may be connected in a wide variety of manners and with one or more connectors configured other than illustrated.

In one or more embodiments, the inner struts 532*a,b* are connected to the outer struts 530*a,b* between the first and second ends thereof. As illustrated, a brace 550 extends between the inner surface 540 of each outer strut 530*a,b* and the outer surface 546 of its corresponding inner strut 532*a,b*. In one or more embodiment, the brace 550 is located generally midway between the first and second ends of the outer struts 530*a,b* and inner struts 532*a,b*.

A main support 552 extends between the base 526 and the end connector 549. As illustrated, the main support 552 lies in the same plane as the inner struts 532*a,b* and outer struts 530*a,b*. Preferably, the main support 552 lies along the central axis. The main support 552 has a pair of opposing faces 556,558 which each face in a direction generally perpendicular to the plane in which the main support 552 lies.

In one or more embodiments, one or more paddles/stabilizers 554 extend outwardly from each face 556,558 of the main support. In one embodiment, a plurality of stabilizers 554 extend outwardly from each face 556,558. As illustrated, four stabilizers 554 extend outwardly from each face 556,558.

In one or more embodiments, each stabilizer 554 comprises a generally planar fin. A first end of each fin is connected to the main support 552, and a second end thereof is positioned outwardly from the body 522 of the apparatus 520. Preferably, the second end of each fin is positioned approximately the same radial distance from the central axis passing through the base 526 as the peripheral edge of the base 526 is from that axis.

In one or more embodiments, this embodiment apparatus 520 may be constructed in a molding process. The apparatus 520 is preferably constructed of a durable and, at least with respect to the struts, a somewhat flexible material.

The function and effect of the apparatus 520 will now be described with reference to the Figures. In use, a roller cover (not shown) is slid over the body 522 of the apparatus 520. In a preferred embodiment, this is accomplished by inserting the distal end 523 of the body 522 into the roller cover and extending the roller cover over the body 522. In one embodiment, the roller cover is pressed onto the body 522 and/or the apparatus 520 is pressed into the roller cover. In one or more embodiments, the roller cover is extended over a substantial portion of the body 522, or at least a sufficient portion that the apparatus 520 grips the roller cover.

As illustrated, in one or more embodiments, the outer struts 530*a,b* are configured such that they are not straight between their first and second ends 534,536. Instead, a central portion of each outer strut 530*a,b* is positioned radially outward of the first and second ends 534,536 of the strut. In one or more embodiments, the body 522 at the base 526 and end connector 549 has a maximum dimension which is slightly less than the size of the opening provided in a roller cover. This configuration aids the user in placing the roller cover on the body 522. As described below, however, an interference may exist between the central portion of each outer strut 530*a,b* and the roller cover.

As the body 522 of the apparatus 520 extends into the roller cover, the outer struts 530*a,b* are pressed inwardly. Because the outer struts 530*a,b* are connected to the inner struts 532*a,b*, this requires that the inner struts 532*a,b* also be pressed inwardly. As will be appreciated, this deformation or change in position of these members generates a corresponding outwardly directed biasing force. This biasing force forces the outer surface 538 of each outer strut 530*a,b* against the inner surface of the roller cover. It will be appreciated that in this embodiment of the invention, it is desirable for at least a portion of the body 522 to have a size in an unbiased condition which is greater than that of the roller cover, and which permits that portion of the body 522 to reduce sufficiently in dimension to permit the insertion of the body 522 into the roller cover. As described above, in a preferred embodiment, this function is served by the struts.

In one or more embodiments, the stabilizers 554 may also have an interfering fit with the roller cover, and be sufficiently flexible to permit their insertion. In another embodiment, the stabilizers 554 are just slightly smaller than a roller cover into which the apparatus 520 is to be inserted. In general, in order to provide the flow generating and stabilizing functions described below, it is preferred that at least one or more of the stabilizers 554 have a size which is nearly the same size as the roller cover.

It will be appreciated that the configuration illustrated is particularly useful in distributing the generated biasing force along a length of the outer struts 530*a,b*, and not just at one or two points. As illustrated, each brace 550 is positioned midway between the ends 534,536 of the outer struts 530*a,b*. Thus, biasing forces generated by the inner struts 532*a,b* are distributed evenly along the central portion of the strut. In addition, a biasing force is generated near each end of each outer strut 530*a,b* at the connection of angled end portions thereof with the central portion. The distributed biasing force causes the body 522 to contact the roller cover along a relatively long contact area. In turn, a large frictional force resulting from the large contact area and biasing force ensure that the roller cover will rotate when the apparatus 520 is rotated.

Once inserted, the stabilizers 554 prevent rocking (i.e. movement of the roller cover about an axis therethrough in a direction other than of rotation) and similar movement of the roller cover with respect to the body 522, maintaining the roller cover securely in position. The stabilizers 554 also serve to reduce the flow of any material through the roller cover towards the drive end of the apparatus 520. As will be appreciated, it is undesirable for cleaning solution, paint or the like to be drawn upwardly through the roller cover and sprayed therefrom at the operator.

In the preferred arrangement of the stabilizers 554 as illustrated, the stabilizers 554 also serve as paddles, moving material through the inside of the roller cover. In particular, when the roller cover is immersed in a cleaning solution, such as water, and the apparatus 520 is rotated, the stabilizers 554 have the effect of moving the solution downwardly out of the roller cover. This reduces splashing of the user, and also contributes to cleaning solution movement around the roller cover, aiding in the cleaning effect. As described, the stabilizers 554 may have a variety of configurations. However, as illustrated, they are angled and separated from one another along the length of the body 520, resulting in good fluid moving capabilities.

In use, a user connects a drive mechanism, such as a drill, to the drive adaptor 522. In one embodiment, the user inserts the chuck insert portion of the drive adaptor 522 into the chuck of a drill. The user uses the drive mechanism to rotate the body 522, and thus the roller cover for cleaning the cover as described in more detail above.

It will be appreciated that the apparatus 520 is configured to provide biasing forces to a roller cover in generally opposing directions. In this manner, the apparatus 520 is maintained in position in the roller cover. In the embodiment described above, the outer struts 530*a,b* act as generally opposing roller cover engaging elements. It will be appreciated that in one or more embodiments, there may be a greater number of outer struts 530*a,b*. For example, three or four such struts may be located 90 or 120 degrees from one another about the base 526. In one embodiment, one or more of the outer struts 530*a,b* may be replaced with another roller cover engaging element, such as a fin or the like. At the same time, at least one of the outer struts 530*a,b* is arranged to move relative to the one or more other portions of the body, thereby permitting the apparatus 520 to be inserted into the roller cover. In addition, means are provided for generating a biasing force which presses the outer strut into engagement with the roller cover.

As described above, the means which creates the biasing force may simply comprise the resiliency of the material comprising one or more parts of the roller cover engaging portion of the body, such as the outer struts 530*a,b* (i.e. without the need for inner struts 532*a,b* or brace 550). In a preferred embodiment, a separate means is provided: the inner strut. Other independent means may be provided for this purpose. For example, a spring or body of compressible material may be positioned between the main support 552 and each outer strut 530*a,b*. In one or more embodiments of the present invention, a biasing/engaging force may be generated after insertion of the apparatus into the roller cover. For example, a lever member or the like may be manipulated by the user, the lever or other member arranged to apply an outwardly directed force upon a roller cover engaging portion of the apparatus or directly upon the roller cover itself.

In one or more embodiments, the stabilizers 554 may be configured to flex or bend, also aiding in the gripping of the roller cover by the apparatus 520. The stabilizers 554 may have other shapes, such as semi-circular, and their number may vary. In one or more embodiments, the stabilizers 554 could be eliminated entirely.

It will be understood that the above described arrangements of the apparatus and the method therefrom are merely illustrative of applications of the principles of this invention and many other embodiments and modifications may be made without departing from the spirit and scope of the invention as defined in the claims.

I claim:

1. An apparatus for cleaning a roller cover utilized to apply a coating material, the roller cover having an open interior area and an exterior for applying a coating material, the roller cover cleaning apparatus comprising:

a body including a supporting base, said body having a first end and a second end, said supporting base located between said first and second ends of said body, said body including a first portion between said first end and said supporting base and a second portion between said second end and said supporting base, said first portion of said body comprising at least one roller cover engaging member extending from said supporting base in a first direction, and said first portion of said body comprising one or more fluid moving paddles adapted to move fluid through said open interior area of a roller cover; and said second portion of said body comprising a drive adaptor extending from said supporting base in a second direction generally opposite said first direction, said drive adaptor for connection to a drive member for rotating said apparatus.

2. The apparatus in accordance with claim 1 wherein said at least one roller cover engaging member comprises a pair of spaced outer struts extending from said supporting base.

3. The apparatus in accordance with claim 2 wherein each outer strut is connected to at least one inner strut extending from said supporting base.

4. The apparatus in accordance with claim 1 including a main support extending from said supporting base, said one or more paddles connected to said main support.

5. The apparatus in accordance with claim 4 wherein said main support has a first side and a second side and said one or more paddles extend outwardly from both said first and second sides of said main support.

6. The apparatus in accordance with claim 4 wherein said at least one roller cover engaging element comprises a pair of struts, said main support located between said struts.

7. The apparatus in accordance with claim 6 wherein said struts are positioned in a first plane and said one or more paddles extend in a second plane generally perpendicular to said first plane.

8. A method of using an apparatus to clean a roller cover utilized to apply a coating material, the roller cover having an open interior area and an exterior area for applying a coating material, the method comprising:

providing a roller cover cleaning apparatus comprising:

a body comprising a support element, at least one roller cover engaging member extending from said support element in a first direction and one or more paddles; and a drive adaptor extending in a second direction generally opposite said first direction from said support element;

locating at least a portion of said roller cover cleaning apparatus in said interior of said roller cover;

engaging at least a portion of said roller cover engaging member with said interior of said roller cover;

engaging said drive element with a rotary drive mechanism;

locating said roller cover in a cleaning fluid;

rotating said roller cover in said cleaning fluid by rotating said roller cover cleaning apparatus with said rotary drive mechanism, said roller cover engaging member engaging said interior of said roller cover, transmitting rotational force from said rotary drive mechanism to said roller cover; and moving fluid with said paddles through said interior of said roller cover.

9. The method in accordance with claim 8 wherein said at least one roller cover engaging member comprises a pair of outwardly extending struts and wherein said engaging step comprises pressing said roller cover over said struts.

10. The method in accordance with claim 8 wherein said engaging step comprises inserting at least a portion of said apparatus into a first end of said roller cover and wherein said moving step comprises moving fluid through said interior of said roller cover towards a second end of said roller cover generally opposite said first end.

11. An apparatus for cleaning a roller cover utilized to apply a coating material, the roller cover having an open interior area and an exterior for applying a coating material, the roller cover cleaning apparatus comprising:

a support element having a first end and a second end;

a pair of outer roller cover engaging struts extending from said first end of said support element, said roller cover engaging struts located in a first plane;

a body extending from said support element and located at least partly between said outer struts, said body having a first side and a second side;

at least one first paddle extending from said first side of said body in a direction generally perpendicular to said first plane;

at least one second paddle extending from said second side of said body in a direction generally perpendicular to said second plane; and a drive adaptor extending from said second end of said support element in a direction generally opposite said struts, said drive adaptor for connection to a drive member for rotating said apparatus.

12. The apparatus in accordance with claim 11 wherein a pair of inner struts extend from said support element, one inner strut located between each outer strut and said body.

13. The apparatus in accordance with claim 12 wherein the inner and outer struts are connected in pairs.

14. The apparatus in accordance with claim 12 wherein a distance from an exterior surface of a first outer strut to a second outer strut is greater than a diameter of an interior of said roller cover.

15. The apparatus in accordance with claim 11 wherein a distance from an end of one of said first paddles to an end of one of said second paddles is nearly the same as a diameter of an interior of said roller cover.

16. The apparatus in accordance with claim 11 wherein said outer struts have a first end connected to support element and a second end connected to a connector member.

* * * * *